US010056030B2

(12) United States Patent
Wu et al.

(10) Patent No.: US 10,056,030 B2
(45) Date of Patent: Aug. 21, 2018

(54) PIXEL CIRCUIT STRUCTURE AND METHOD FOR DRIVING THE SAME

(71) Applicant: AU Optronics Corporation, Hsin-Chu (TW)

(72) Inventors: Tsung-Tien Wu, Hsin-Chu (TW); Tsung-Yi Lin, Hsin-Chu (TW); Cheng-Chieh Chang, Hsin-Chu (TW); Pin-Miao Liu, Hsin-Chu (TW); Kang-Hung Liu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 374 days.

(21) Appl. No.: 14/840,190

(22) Filed: Aug. 31, 2015

(65) Prior Publication Data

US 2016/0314731 A1 Oct. 27, 2016

(30) Foreign Application Priority Data

Apr. 21, 2015 (TW) ..... 104112730 A

(51) Int. Cl.
*G09G 3/3225* (2016.01)

(52) U.S. Cl.
CPC ... *G09G 3/3225* (2013.01); *G09G 2300/0452* (2013.01); *G09G 2300/0804* (2013.01); *G09G 2300/0814* (2013.01)

(58) Field of Classification Search
CPC ..... G09G 3/3208; G09G 3/32; G09G 3/3225; G09G 3/3258; G09G 3/3233; G09G 2300/0452; G09G 2300/0804; G09G 2300/0814
See application file for complete search history.

(56) References Cited

U.S. PATENT DOCUMENTS

| | | | | |
|---|---|---|---|---|
| 8,237,582 | B2 | 8/2012 | Ries, II | |
| 8,410,680 | B2 | 4/2013 | Medendorp, Jr. et al. | |
| 9,035,980 | B2 | 5/2015 | Yang et al. | |
| 2005/0200573 | A1 | 9/2005 | Kwak | |
| 2006/0087478 | A1 | 4/2006 | Eom | |
| 2006/0125737 | A1 * | 6/2006 | Kwak ..... | G09G 3/3233 345/76 |
| 2009/0281604 | A1 | 11/2009 | De Boer et al. | |
| 2010/0265284 | A1 | 10/2010 | Satou et al. | |
| 2011/0242072 | A1 | 10/2011 | Ota | |

(Continued)

FOREIGN PATENT DOCUMENTS

| | | | |
|---|---|---|---|
| CN | 1670800 | A | 9/2005 |
| CN | 101661709 | A | 3/2010 |

(Continued)

*Primary Examiner* — Jennifer Mehmood
*Assistant Examiner* — James Nokham
(74) *Attorney, Agent, or Firm* — WPAT, PC

(57) ABSTRACT

A pixel structure includes a plurality of sub-pixels. Each of the sub-pixels includes a first light-emitting diode (LED) and a second LED. The first LED is configured to emit a first color light. The second LED is configured to emit a second color light. Each of the first LED and the second LED includes an anode and a cathode. The anode of the first LED and the anode of the second LED are coupled to a same signal line. The cathode of the first LED and the cathode of the second LED are coupled to different signal lines.

37 Claims, 12 Drawing Sheets

(56) References Cited

U.S. PATENT DOCUMENTS

| | | | | |
|---|---|---|---|---|
| 2012/0313903 | A1* | 12/2012 | Pyon | G09G 3/32 345/204 |
| 2014/0103830 | A1 | 4/2014 | Lin et al. | |
| 2014/0111559 | A1 | 4/2014 | Yang et al. | |
| 2014/0217429 | A1 | 8/2014 | Lin et al. | |
| 2014/0319486 | A1* | 10/2014 | Hong | G09G 3/32 257/40 |
| 2015/0269886 | A1* | 9/2015 | Tan | G09G 3/3208 345/698 |
| 2015/0302797 | A1* | 10/2015 | Lu | G09G 3/3225 345/83 |
| 2015/0339972 | A1 | 11/2015 | Xu | |
| 2016/0210892 | A1* | 7/2016 | Ohara | G09G 3/3258 |

FOREIGN PATENT DOCUMENTS

| | | | |
|---|---|---|---|
| CN | 202178255 | | 3/2012 |
| CN | 203071067 | | 7/2013 |
| CN | 103325340 | A | 9/2013 |
| CN | 103855192 | A | 6/2014 |
| TW | 201019014 | A1 | 5/2010 |
| TW | 201415947 | A | 4/2014 |
| TW | 201417077 | A | 5/2014 |
| TW | 201432360 | A | 8/2014 |

* cited by examiner

PIXEL CIRCUIT STRUCTURE AND METHOD FOR DRIVING THE SAME

RELATED APPLICATIONS

This application claims priority to Taiwan Application Serial Number 104112730, filed Apr. 21, 2015, which is herein incorporated by reference.

BACKGROUND

Field of Disclosure

The present disclosure relates to a display technology. More particularly, the present disclosure relates to a pixel structure and a method for driving the same.

Description of Related Art

For a display constituted by light-emitting diodes (LEDs), the heat quantity causing the temperature change of the display mostly comes from the interior of the display. In greater detail, the heat quantity emitted from the LEDs themselves is a main cause for the temperature rise of the display. Once the display temperature rises, the luminous efficiency of the LEDs inside the display is seriously impacted.

For the forgoing reasons, there is a need to solve the above-mentioned problems by providing a pixel structure and a method for driving the same.

SUMMARY

A pixel structure is provided. The pixel structure comprises a plurality of sub-pixels. Each of the sub-pixels comprises a first light-emitting diode (LED) and a second LED. The first LED is configured to emit a first color light. The second LED is configured to emit a second color light. Each of the first LED and the second LED comprises an anode and a cathode. The anode of the first LED and the anode of the second LED are coupled to a same signal line. The cathode of the first LED and the cathode of the second LED are coupled to different signal lines.

The disclosure provides a method for driving a pixel structure. The pixel structure comprises a plurality of sub-pixels. Each of the sub-pixels comprises a first light-emitting diode (LED) and a second LED. Each of the first LED and the second LED comprises an anode and a cathode. The anode of the first LED and the anode of the second LED are coupled to a same signal line. The cathode of the first LED and the cathode of the second LED are coupled to different signal lines. The method for driving the pixel structure comprises: controlling the first LED to emit a first color light; and controlling the second LED to emit a second color light.

As a result, according to the disclosure of the present disclosure, the embodiments of the present disclosure provides a pixel structure and a method for driving the same to improve the problem that the luminous efficiency of the LEDs in the display is seriously impacted because of the temperature rise of the display.

It is to be understood that both the foregoing general description and the following detailed description are by examples, and are intended to provide further explanation of the disclosure as claimed.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure. In the drawings.

Figure 1:
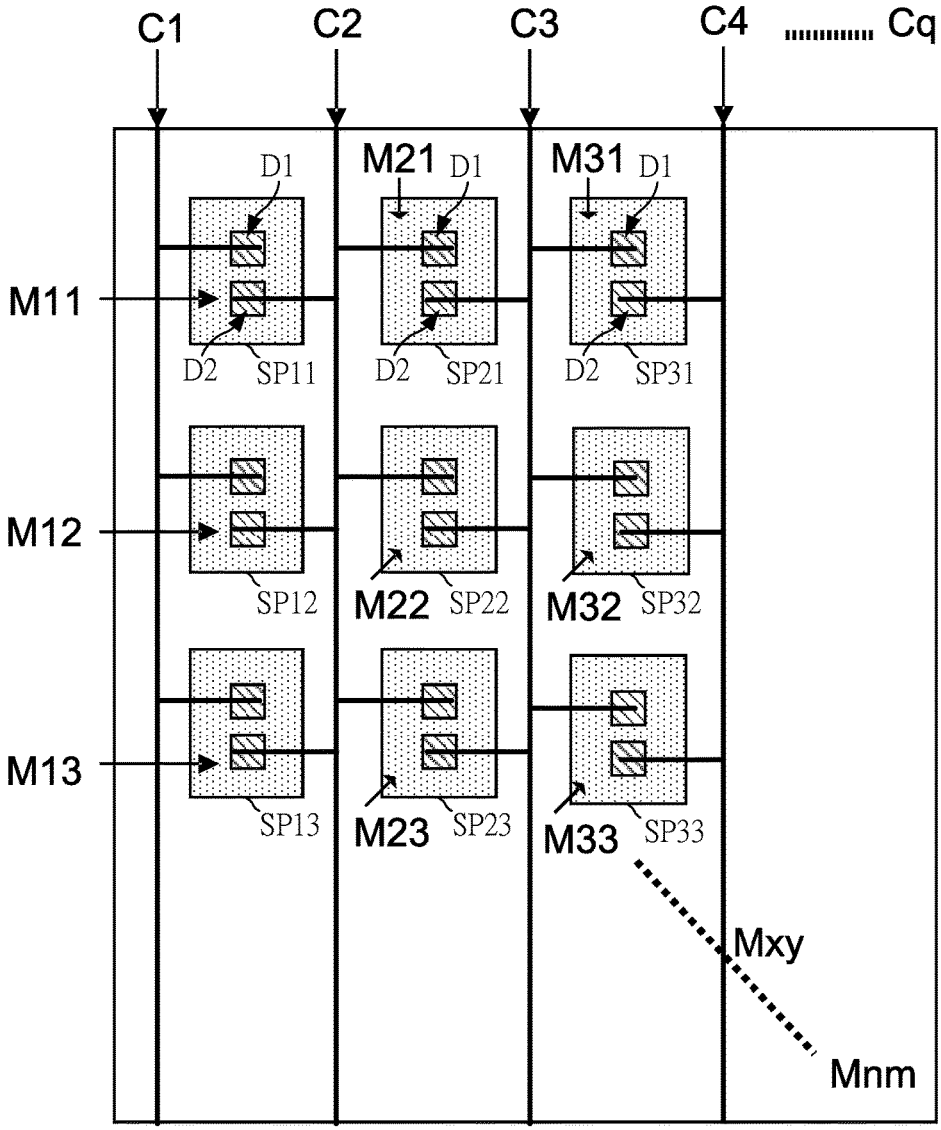
FIG. 1 depicts a schematic diagram of a circuit configuration of a display panel according to one embodiment of this disclosure.

In accordance with common practice, the various described features/elements are not drawn to scale but instead are drawn to best illustrate specific features/elements relevant to the present disclosure. Also, like reference numerals and designations in the various drawings are used to indicate like elements/parts.

DESCRIPTION OF THE EMBODIMENTS

To make the contents of the present disclosure more thorough and complete, the following illustrative description is given with regard to the implementation aspects and embodiments of the present disclosure, which is not intended to limit the scope of the present disclosure. The features of the embodiments and the steps of the method and their sequences that constitute and implement the embodiments are described. However, other embodiments may be used to achieve the same or equivalent functions and step sequences.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular. Specifically, as used herein and in the claims, the singular forms "a" and "an" include the plural reference unless the context clearly indicates otherwise.

As used herein, "couple" refers to direct physical contact or electrical contact or indirect physical contact or electrical contact between two or more devices. Or it can also refer to reciprocal operations or actions between two or more devices.

FIG. 1 depicts a schematic diagram of a circuit configuration of a display panel according to one embodiment of this disclosure. As shown in the figure, a pixel structure comprises a plurality of sub-pixels SP11-SP33. Each of the sub-pixels (such as SP11) comprises a first LED D1 and a second LED D2. The first LED D1 is configured to emit a first color light. The second LED D2 is configured to emit a second color light.

Figure 2:
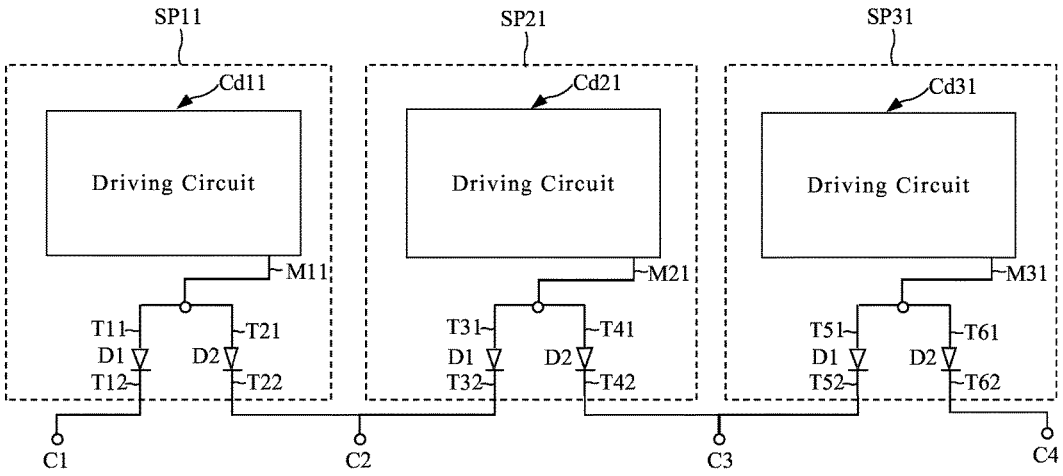
FIG. 2 depicts a schematic diagram of a circuit configuration of a display panel according to another embodiment of this disclosure.

In order to facilitate the understanding of the present disclosure, a description is provided with reference to FIG. 1 and FIG. 2. FIG. 2 depicts a schematic diagram of a circuit configuration of a display panel according to another embodiment of this disclosure. The first LED D1 and the second LED D2 respectively comprise anodes T11, T21 and cathodes T12, T22. The anode T11 of the first LED D1 and the anode T21 of the second LED D2 are coupled to a same signal line M11. The cathode T12 of the first LED D1 and the cathode T22 of the second LED D2 are coupled to different signal lines C1, C2.

Figure 3:
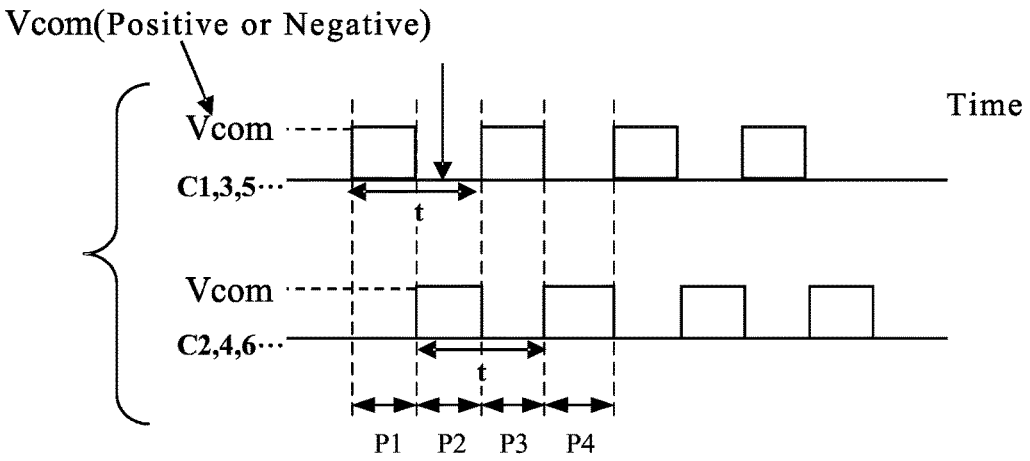
FIG. 3 depicts a schematic diagram of driving waveforms according to still another embodiment of this disclosure.

In order to facilitate the understanding of the method for driving the LEDs according to the present disclosure, a description is provided with reference to FIG. 2 and FIG. 3. FIG. 3 depicts a schematic diagram of driving waveforms according to still another embodiment of this disclosure. In operation, the first LED D1 emits a first color light during a first period P1, and the second LED D2 emits a second color light during a second period P2. The first color light is the same as the second color light. For example, after the first LED D1 emits a red light during the first period P1, the second LED D2 emits the red light during the second period P2. Hence, the sub-pixel SP11 configured to emit the red light can utilize the first LED D1 and the second LED D2 to emit the red light alternately, so that the first LED D1 can dissipate heat when the second LED D2 emits the red light to avoid heat accumulation. The luminous efficiency of the first LED D1 is thus not affected, and neither is the second LED D2. In another embodiment, the first LED D1 and the second LED D2 may also emit light at a same time. In other words, the signal lines C1, C2, which is similar to a common electrode structure, can provide a same signal.

In another embodiment, a description is provided with reference to FIG. 2. The anode T11 of the first LED D1 and the anode T21 of the second LED D2 are both coupled to a first signal line M11. The cathode T12 of the first LED D1 and the cathode T22 of the second LED D2 are respectively coupled to a second signal line C1 and a third signal line C2.

In still another embodiment, a description is provided with reference to FIG. 2 and FIG. 3. The second signal line C1 is coupled to a first common electrode (not shown in the figure). The third signal line C2 is coupled to a second common electrode (not shown in the figure). The first common electrode provides a high-level first common voltage to the second signal line C1 during the first period P1, and provides a low-level first common voltage to the second signal line C1 during the second period P2. In addition, the second common electrode provides a high-level second common voltage to the third signal line C2 during the second period P2, and provides a low-level second common voltage to the third signal line C2 during the first period P1. As a result, the embodiment according to the present disclosure can utilize the second signal line C1 and the third signal line C2 to respectively control the first LED D1 and the second LED D2, so that the first LED D1 and the second LED D2 emit light alternately.

In yet another embodiment, a description is provided with reference to FIG. 2. The sub-pixel (such as SP11) of the pixel structure further comprises a driving circuit Cd11 coupled to the first signal line M11. The driving circuit Cd11 is configured to control the first LED D1 in cooperation with the first common electrode (the second signal line C1 is coupled to the first common electrode), and control the second LED D2 in cooperation with the second common electrode (the third signal line C2 is coupled to the second common electrode).

Figure 4:
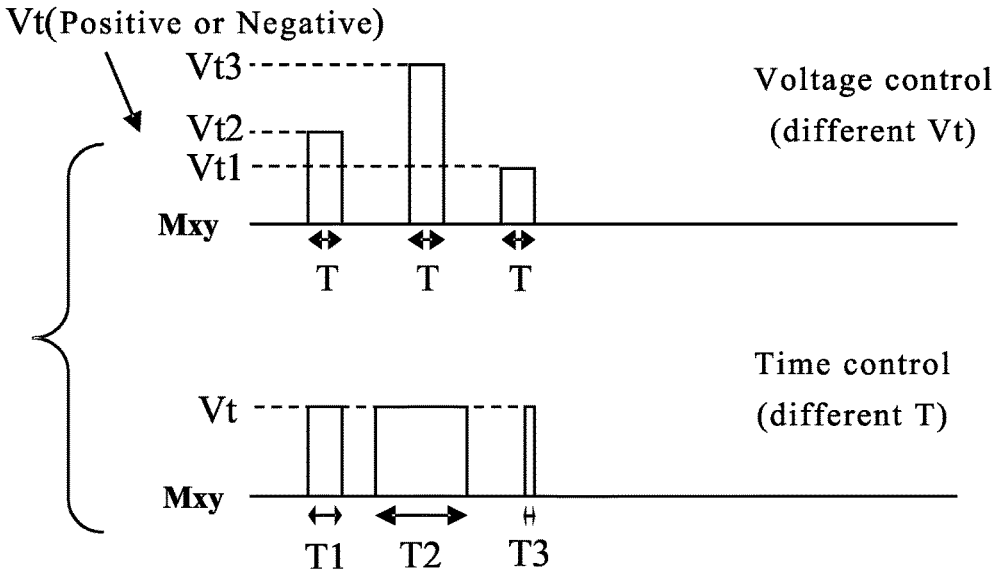
FIG. 4 depicts a schematic diagram of driving waveforms according to yet another embodiment of this disclosure.

In another embodiment, a description is provided with reference to FIG. 2 and FIG. 4. FIG. 4 depicts a schematic diagram of driving waveforms according to yet another embodiment of this disclosure. The driving circuit Cd11 is configured to provide a driving signal to the first signal line M11. The driving signal comprises various voltage levels Vt1-Vt3, or the driving signal comprises various periods T1-T3. Hence, the driving circuit Cd11 can drive the first LED D1 and the second LED D2 either through a voltage control manner (different voltage levels Vt1-Vt3) or a time control manner (different periods T11-T3).

In still another embodiment, a description is provided with reference to FIG. 2. The method for driving the first LED D1 and the second LED D2 is illustrated by way of example as follows. When the first LED D1 emits light, the second LED D2 does not emit light. When the second LED D2 emits light, the first LED D1 does not emit light. Such an alternate emitting mode would avoid heat accumulation so that the luminous efficiency of the first LED D1 and the second LED D2 is not affected.

Figure 5:
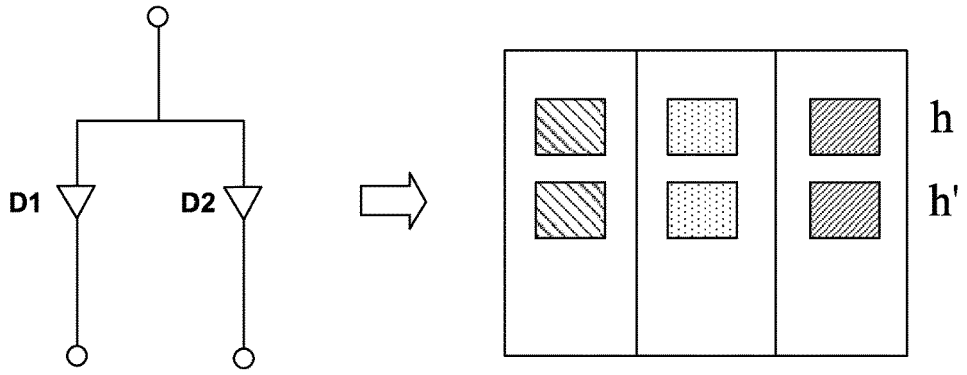
FIG. 5 depicts a schematic diagram of a configuration of LEDs in a display panel according to another embodiment of this disclosure.

FIG. 5 depicts a schematic diagram of a configuration of LEDs in a display panel according to another embodiment of this disclosure. As shown in the figure, the first color light emitted by the first LED D1 is the same as the second color light emitted by the second LED D2, and a frequency spectrum peak value h of the first color light is different from a frequency spectrum peak value h' of the second color light. In this manner, the adjustable color gamut of the LEDs is enlarged and the national television system committee (NTSC) range being covered is also enlarged to improve the color gamut of the display panel.

Figure 6:
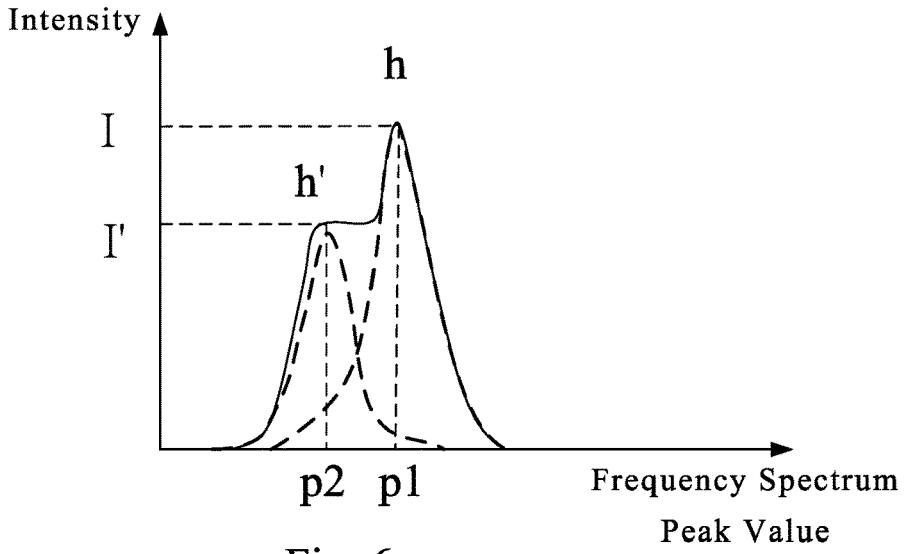
FIG. 6 depicts a schematic diagram of frequency spectrum peak values of LEDs in a display panel according to still another embodiment of this disclosure.

FIG. 6 depicts a schematic diagram of frequency spectrum peak values of LEDs in a display panel according to still another embodiment of this disclosure. As shown in the figure, the frequency spectrum peak value h of the first color light corresponds to a first wavelength p1. The frequency spectrum peak value h' of the second color light corresponds to a second wavelength p2. A wavelength difference between the first wavelength p1 and the second wavelength p2 is substantially less than or equal to 50 nanometers (nms). In addition, the frequency spectrum peak value h of the first color light corresponds to a first intensity I. The frequency spectrum peak value h' of the second color light corresponds to a second intensity I'.

Figure 7:
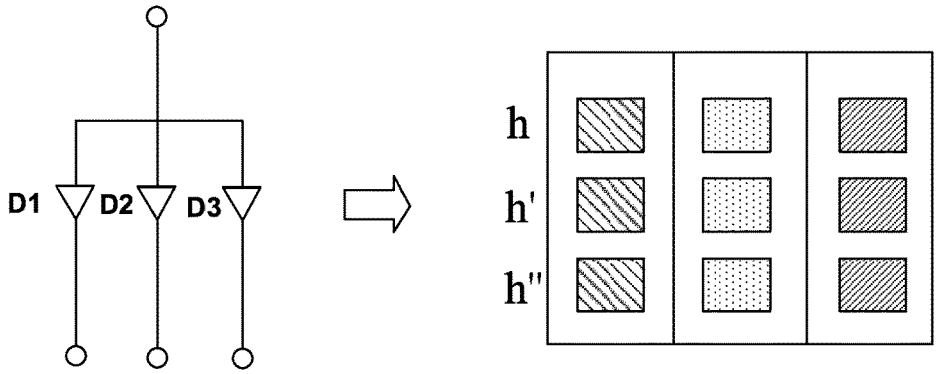
FIG. 7 depicts a schematic diagram of a configuration of LEDs in a display panel according to yet another embodiment of this disclosure.

FIG. 7 depicts a schematic diagram of a configuration of LEDs in a display panel according to yet another embodiment of this disclosure. As shown in the figure, each of the sub-pixels (such as SP11) of the pixel structure further comprises a third LED D3. The third LED D3 is configured to emit a third color light. The first color light, the second color light, and the third color light are the same, and the frequency spectrum peak value h of the first color light, the frequency spectrum peak value h' of the second color light, and a frequency spectrum peak value h" of the third color light are different so as to further enlarge the adjustable color gamut of the LEDs. Additionally, the NTSC range being covered is also further enlarged to improve the color gamut of the display panel.

Figure 8:
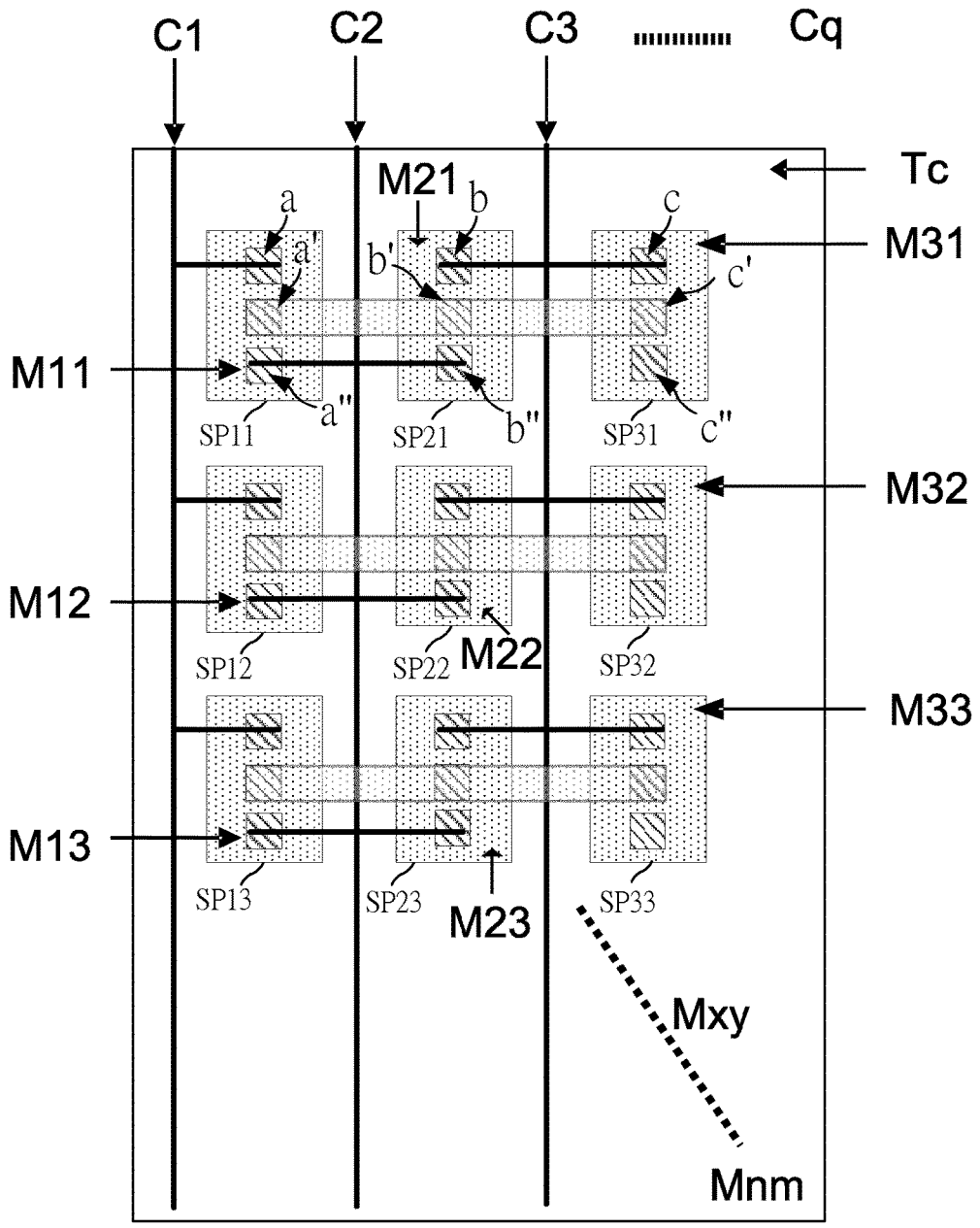
FIG. 8 depicts a schematic diagram of a circuit configuration of a display panel according to another embodiment of this disclosure.

FIG. 8 depicts a schematic diagram of a circuit configuration of a display panel according to another embodiment of this disclosure. As shown in the figure, the pixel structure comprises the plurality of sub-pixels SP11-SP33. Each of the sub-pixels (such as SP11) comprises a first LED a, a second LED a', and a third LED a". The first LED a is configured to emit the first color light. The second LED a' is configured to emit the second color light. The third LED a" is configured to emit the third color light.

Figure 9:
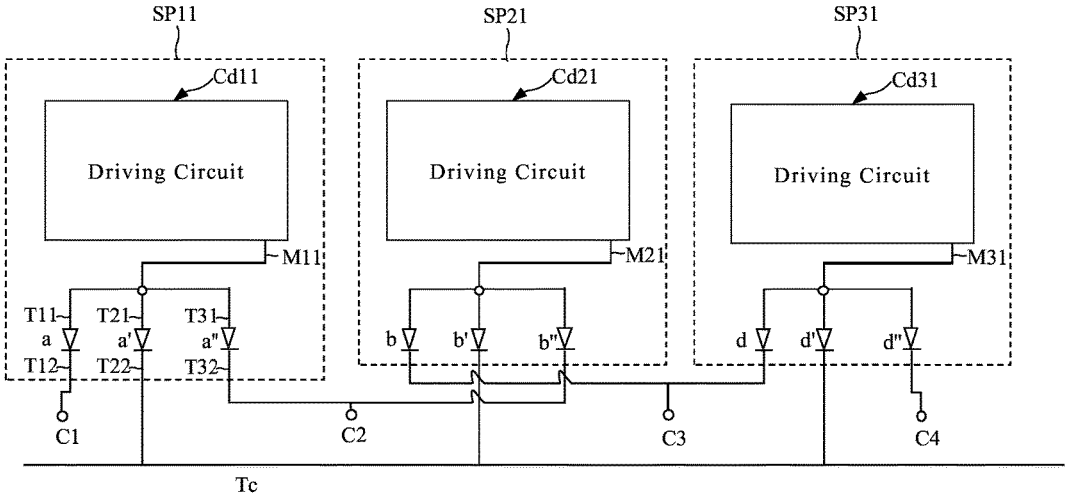
FIG. 9 depicts a schematic diagram of a circuit configuration of a display panel according to still another embodiment of this disclosure.

In order to facilitate the understanding of the present disclosure, a description is provided with reference to FIG. 8 and FIG. 9. FIG. 9 depicts a schematic diagram of a circuit configuration of a display panel according to still another embodiment of this disclosure. The first LED a, the second LED a', and the third LED a" respectively comprise anodes T11, T21, T31 and the cathodes T12, T22, T32. The anode T11 of the first LED a, the anode T21 of the second LED a', and the anode T31 of the third LED a" are coupled to the same signal line M11. The cathode T12 of the first LED a, the cathode T22 of the second LED a', and the cathode T32 of the third LED a" are respectively coupled to different signal lines C1, Tc, C2.

In another embodiment, a description is provided with reference to FIG. 9. The anode T11 of the first LED a, the anode T21 of the second LED a', and the anode T31 of the third LED a" are all coupled to the first signal line M11. In addition, the cathode T12 of the first LED a, the cathode T22 of the second LED a', and the cathode T32 of the third LED a" are respectively coupled to the second signal line C1, a third signal line Tc, and a fourth signal line C2.

Figure 10:
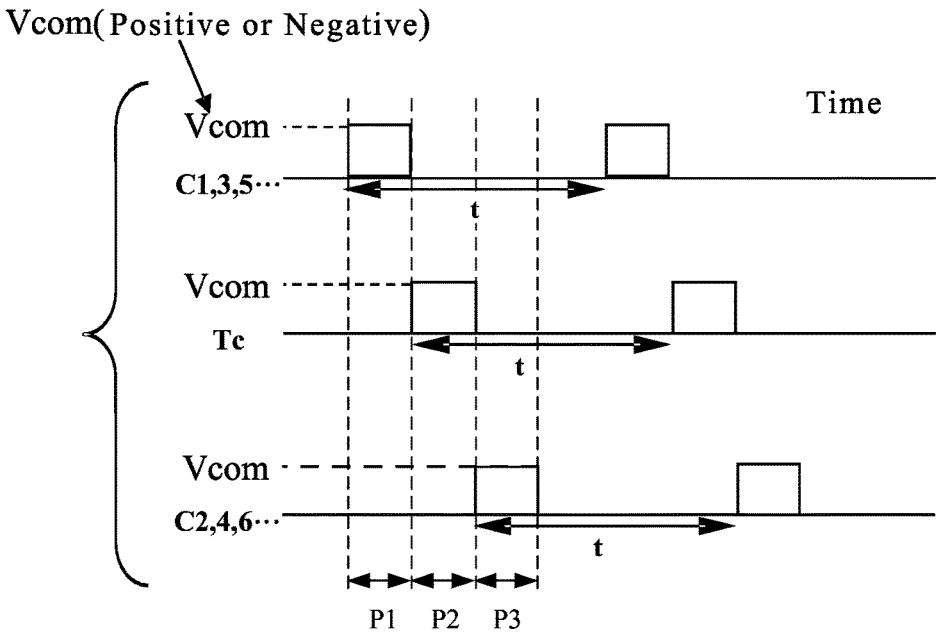
FIG. 10 depicts a schematic diagram of driving waveforms according to yet another embodiment of this disclosure.

In order to facilitate the understanding of the method for driving the LEDs according to the present disclosure, a description is provided with reference to FIG. 9 and FIG. 10. FIG. 10 depicts a schematic diagram of driving waveforms according to yet another embodiment of this disclosure. In operation, the second signal line C1 receives the high-level first common voltage during the first period P1. The third signal line Tc receives the high-level second common voltage during the second period P2. The fourth signal line C2 receives a high-level third common voltage during a third period P3. Hence, the first LED a, the second LED a', and the third LED a" can be respectively operated by utilizing the above configuration and driving method.

Figure 11:
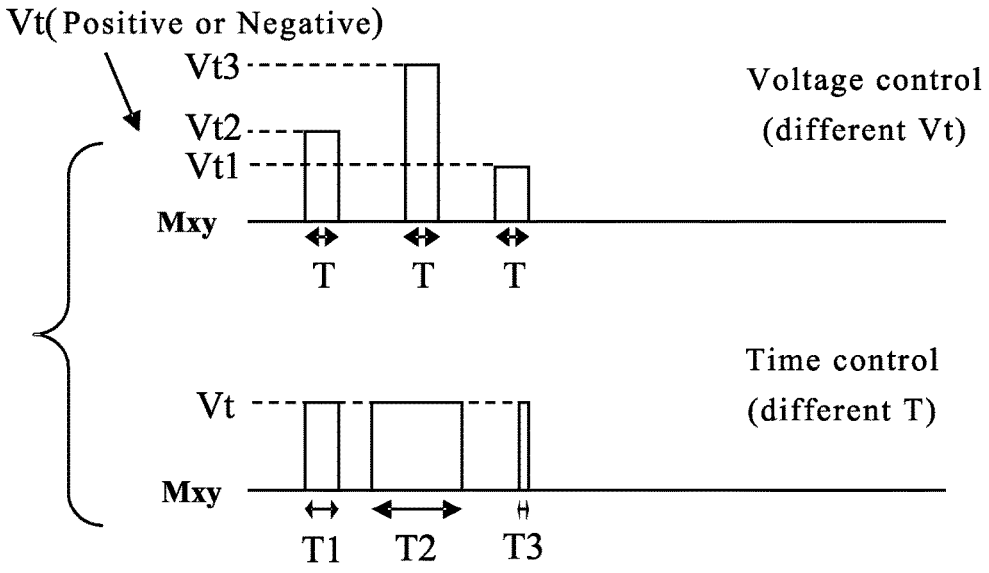
FIG. 11 depicts a schematic diagram of driving waveforms according to another embodiment of this disclosure.

In another embodiment, a description is provided with reference to FIG. 9 and FIG. 11. FIG. 11 depicts a schematic diagram of driving waveforms according to another embodiment of this disclosure. As shown in the figure, the sub-pixel (such as SP11) of the pixel structure further comprises the driving circuit Cd11 coupled to the first signal line M11. The driving circuit Cd11 is configured to provide the driving signal to the first signal line M11. The driving signal comprises the various voltage levels Vt1-Vt3, or the driving signal comprises the various periods T1-T3. The driving circuit Cd11 is configured to control the first LED a according to the driving signal and the first common voltage (the second signal line C1 receives the first common voltage), control the second LED a' according to the driving signal and the second common voltage (the third signal line Tc receives the second common voltage), and control the third LED a" according to the driving signal and the third common voltage (the fourth signal line C2 receives the third common voltage). Hence, the driving circuit Cd11 can drive the first LED a, the second LED a', and the third LED a" either through a voltage driving manner (different voltage levels Vt1-Vt3) or a time driving manner (different periods T1-T3).

Figure 12:
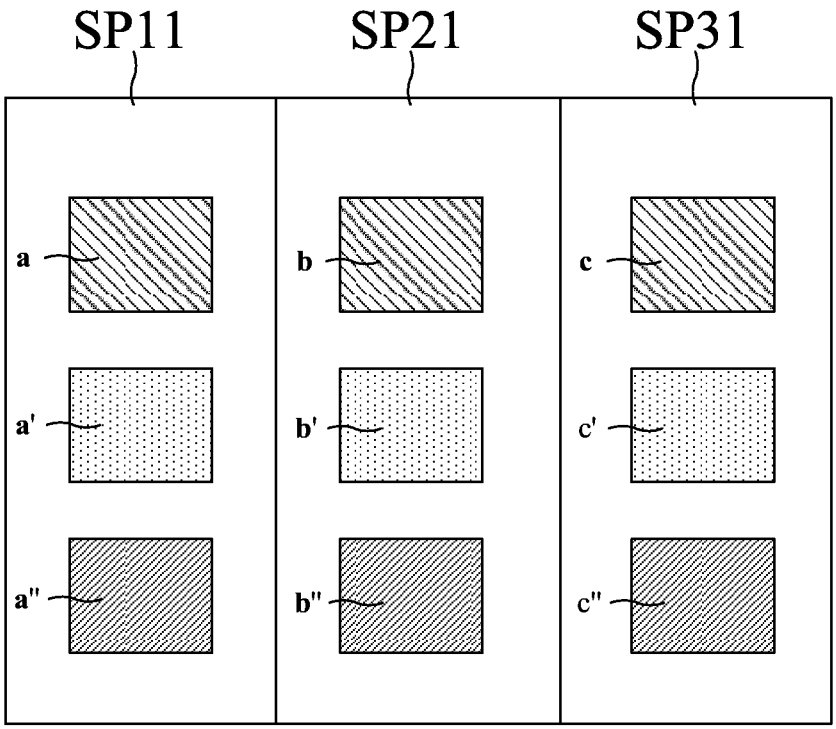
FIG. 12 depicts a schematic diagram of a configuration of a pixel in a display panel according to still another embodiment of this disclosure.

FIG. 12 depicts a schematic diagram of a configuration of a pixel in a display panel according to still another embodiment of this disclosure. As shown in the figure, the plurality of sub-pixels of the pixel structure comprises the first sub-pixel SP11, the second sub-pixel SP21, and the third sub-pixel SP31. The first sub-pixel SP11, the second sub-pixel SP21, and the third sub-pixel SP 31 respectively emit one of the first color light, the second color light, and the third color light to allow the pixel structure to simultaneously emit the first color light, the second color light, and the third color light. For example, during the first period P1, the first LED a in the first sub-pixel SP11 emits the first color light (such as red light), a second LED b' in the second sub-pixel SP21 emits the second color light (such as green light), and a third LED c" in the third sub-pixel SP31 emits the third color light (such as blue light). During the second period P2, the second LED a' in the first sub-pixel SP11 emits the second color light (such as green light), a third LED b" in the second sub-pixel SP21 emits the third color light (such as blue light), and a first LED c in the third sub-pixel SP31 emits the first color light (such as red light).

In addition, during the third period P3, the third LED a" in the first sub-pixel SP11 emits the third color light (such as blue light), a first LED b in the second sub-pixel SP21 emits the first color light (such as red light), and a second LED c' in the third sub-pixel SP31 emits the second color light (such as green light). As shown above, in the present embodiment, a red (R) LED, a green (G) LED, and a blue (B) LED in each of the first sub-pixel SP11, the second sub-pixel SP21, and the third sub-pixel SP31 can take turns to emit light to improve heat dissipation efficiency so as to avoid heat accumulation. The luminous efficiency of LEDs is thus not affected. Additionally, emitting lights in turn would lengthen the lifetime of LEDs.

In another embodiment, the plurality of sub-pixels of the pixel structure comprise the first sub-pixel SP11, the second sub-pixel SP21, and the third sub-pixel SP31. During the first period P1, the first sub-pixel SP11, the second sub-pixel SP21, and the third sub-pixel SP31 simultaneously emit the first color light (such as red light). During the second period P2, the first sub-pixel SP11, the second sub-pixel SP21, and the third sub-pixel SP31 simultaneously emit the second color light (such as green light). In addition, during the third period P3, the first sub-pixel SP11, the second sub-pixel SP21, and the third sub-pixel SP31 simultaneously emit the third color light (such as blue light). In another embodiment, during the third period P3, the first sub-pixel SP11, the second sub-pixel SP21, and the third sub-pixel SP 31 simultaneously emit the first color light (such as red light), the second color light (such as green light), and the third color light (such as blue light). Or, the first sub-pixel SP11, the second sub-pixel SP21, and the third sub-pixel SP 31 simultaneously emit any two of the first color light (such as red light), the second color light (such as green light), and the third color light (such as blue light), for example, simultaneously emit the first color light (such as red light) and the second color light (such as green light), or simultaneously emit the second color light (such as green light) and the third color light (such as blue light), or simultaneously emit the first color light (such as red light) and the third color light (such as blue light). As shown above, in the present embodiment, applying the field sequential color (FSC) method to the pixel structure adopting LEDs allows the resolution to be further improved.

Figure 13:
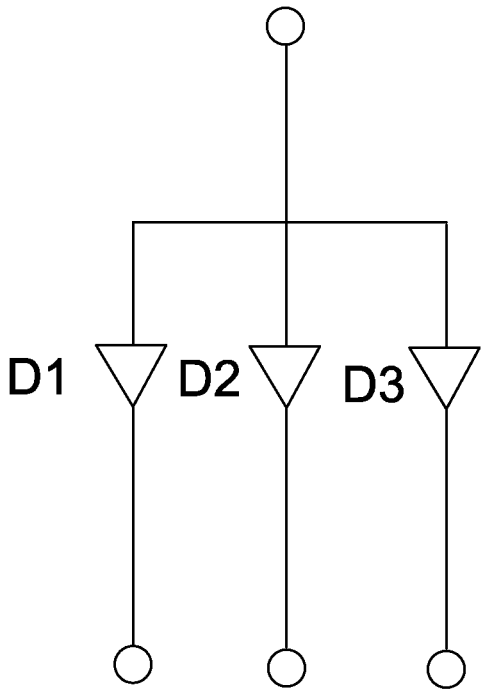
FIG. 13 depicts a schematic diagram of a configuration of LEDs in a display panel according to yet another embodiment of this disclosure.

FIG. 13 depicts a schematic diagram of a configuration of LEDs in a display panel according to yet another embodiment of this disclosure. According to the present embodiment, LEDs can be controlled by utilizing an integrated circuit (IC). The IC (not shown in the figure) is coupled to the first LED D1, the second LED D2, and the third LED D3, and configured to control the first LED D1, the second LED D2, and the third LED D3. In the present embodiment, the LEDs in a pixel are controlled by the IC. Since one IC is able to control multiple LEDs and an IC is small, the resolution is thus improved.

Figure 14:
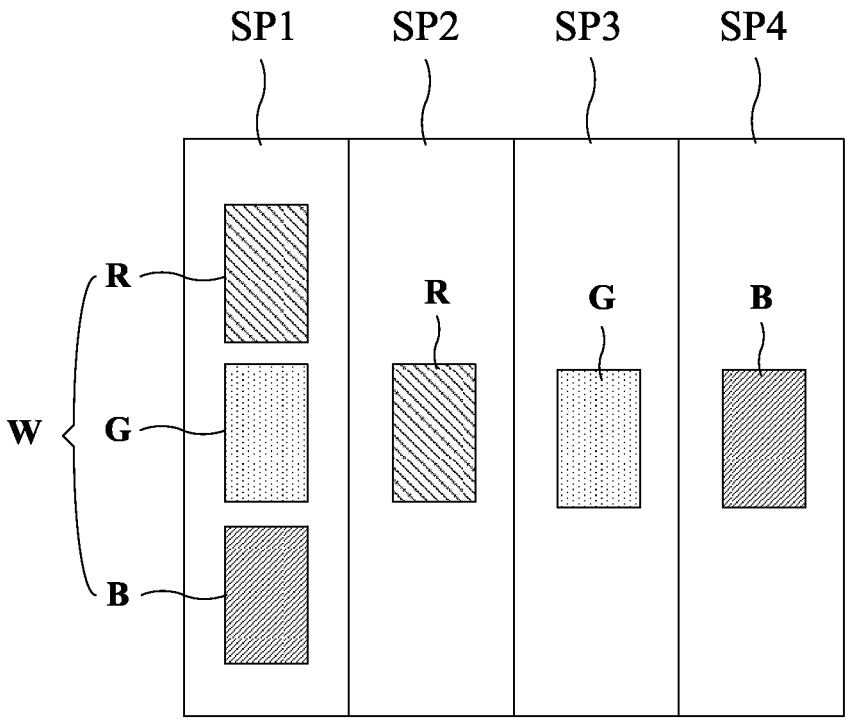
FIG. 14 depicts a schematic diagram of a configuration of a pixel in a display panel according to still another embodiment of this disclosure.
Figure 15:
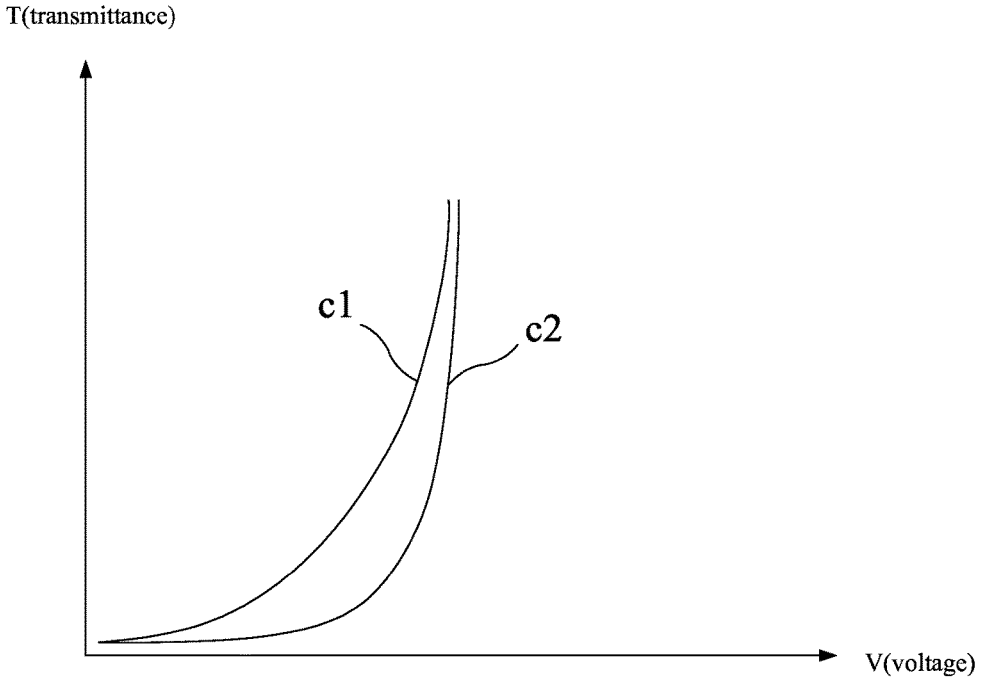
FIG. 15 depicts a schematic diagram of a voltage-transmittance curve according to yet another embodiment of this disclosure.

FIG. 14 depicts a schematic diagram of a configuration of a pixel in a display panel according to still another embodiment of this disclosure. As shown in the figure, under the circuit configuration structure of the display panel shown in FIG. 8 and FIG. 9, an additional sub-pixel SP1 may be configured in a pixel. The sub-pixel SP1 comprises the red LED, the green LED, and the blue LED so as to emit white light W. Adopting the above configuration can adjust the brightness and voltage-transmittance curve (V-T curve) to better the luminous efficiency and brightness. The voltage-transmittance curve may be referred to FIG. 15. As shown in the figure, curve C1 is an experimental curve representing a pixel being configured with the additional sub-pixel SP1. Curve C2 is an experimental curve representing each of the sub-pixels in a pixel being configured with only one LED. The transmittance of the curve C1 is superior to the transmittance of the curve C2 as shown in the figure, thus proving that the additionally configured sub-pixel SP1 can actually improve the luminous efficiency and brightness.

Figure 16:
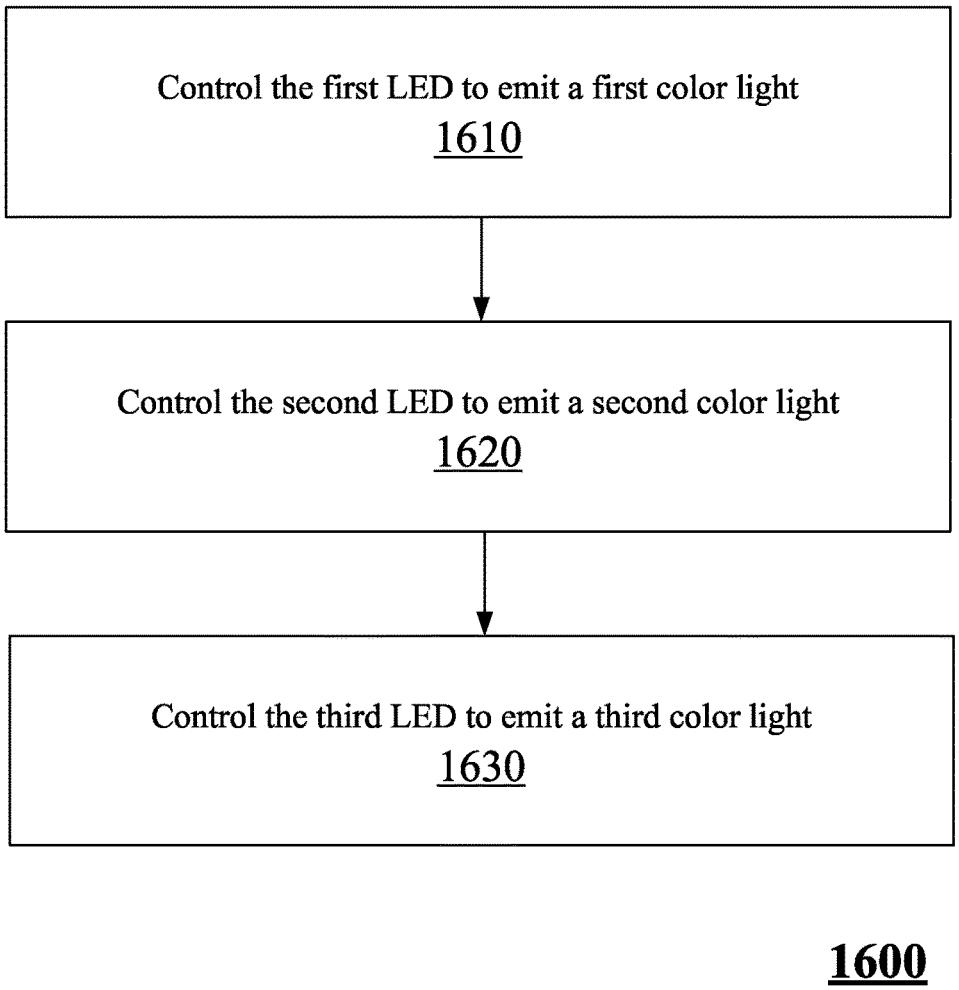
FIG. 16 depicts a flowchart of a method for driving a pixel structure according to yet another embodiment of this disclosure.

FIG. 16 depicts a flowchart of a method for driving a pixel structure according to yet another embodiment of this disclosure. As shown in the figure, a method 1600 for driving a pixel structure comprises the following steps:

step 1610: controlling the first LED D1 to emit a first color light; and step 1620: controlling the second LED D2 to emit a second color light.

In order to facilitate the understanding of the method 1600 for driving the pixel structure, a description is provided with reference to FIG. 1, FIG. 2, and FIG. 16. In step 1610, the signal line M11 and the signal line C1 can be utilized to control the first LED D1 to emit the first color light. In step 1620, the signal line M11 and the signal line C2 can be utilized to control the second LED D2 to emit the second color light.

In another embodiment, a description is provided with reference to FIG. 2, FIG. 3, and FIG. 16. Step 1610 comprises: controlling the first LED to emit the first color light during the first period. In this step, the first LED D1 can be controlled to emit the first color light during the first period P1 by utilizing the first signal line M11 and the second signal line C1. In addition, step 1620 comprises: controlling the second LED to emit the second color light during the second period. The first color light is the same as the second color light. In this step, the second LED D2 can be controlled to emit the second color light during the second period P2 by utilizing the first signal line M11 and the third signal line C2. The first color light is the same as the second color light. For example, after the first LED D1 emits the red light during the first period P1, the second LED D2 emits the red light during the second period P2. Hence, the sub-pixel SP11 configured to emit the red light can utilize the first LED D1 and the second LED D2 to emit the red light alternately, so that the first LED D1 can dissipate heat when the second LED D2 emits the red light to avoid heat accumulation. The luminous efficiency of the first LED D1 is thus not affected, and neither is the second LED D2.

In still another embodiment, a description is provided with reference to FIG. 2 and FIG. 3. The method 1600 for driving the pixel structure further comprises: providing the high-level first common voltage to the second signal line C1 during the first period P1 and providing the low-level first common voltage to the second signal line C1 during the second period P2 by the first common electrode (the second signal line C1 is coupled to the first common electrode). Additionally, the method 1600 for driving the pixel structure further comprises: providing the high-level second common voltage to the third signal line C2 during the second period P2 and providing the low-level second common voltage to the third signal line C2 during the first period P1 by the second common electrode (the third signal line C2 is coupled to the second common electrode). As a result, the embodiment according to the present disclosure can utilize the second signal line C1 and the third signal line C2 to respectively control the first LED D1 and the second LED D2, so that the first LED D1 and the second LED D2 emit light alternately.

In yet another embodiment, a description is provided with reference to FIG. 2 and FIG. 16. Step 1610 further comprises: controlling the first LED D1 to emit the first color light by the driving circuit in cooperation with the first common electrode. In this step, the driving circuit Cd11 is utilized to control the first LED D1 to emit the first color light in cooperation with the first common electrode (the second signal line C1 is coupled to the first common electrode). Additionally, step 1620 further comprises: controlling the second LED to emit the second color light by the driving circuit Cd11 in cooperation with the second common electrode. In this step, the driving circuit Cd11 is utilized to control the second LED D2 to emit the second color light in cooperation with the second common electrode (the third signal line C2 is coupled to the second common electrode).

In another embodiment, a description is provided with reference to FIG. 2 and FIG. 3. The method 1600 for driving the pixel structure further comprises: providing the driving signal to the first signal line M11 by the driving circuit Cd11. The driving signal comprises various voltage levels Vt1-Vt3, or the driving signal comprises various periods T1-T3. Hence, the driving circuit Cd11 can drive the first LED D1 and the second LED D2 either through the voltage driving manner (different voltage levels Vt1-Vt3) or the time driving manner (different periods T1-T3).

In still another embodiment, a description is provided with reference to FIG. 5 and FIG. 16. In step 1610 and step 1620, the first color light emitted by the first LED D1 is the same as the second color light emitted by the second LED D2, and the frequency spectrum peak value h of the first color light is different from the frequency spectrum peak value h' of the second color light. In this manner, the adjustable color gamut of the LEDs is enlarged and the NTSC range being covered is also enlarged to improve the color gamut of the display panel.

In yet another embodiment, the frequency spectrum peak value h of the first color light corresponds to the first wavelength p1. The frequency spectrum peak value h' of the second color light corresponds to the second wavelength p2. The wavelength difference between the first wavelength p1 and the second wavelength p2 is substantially less than or equal to 50 nanometers (nms).

In another embodiment, a description is provided with reference to FIG. 7 and FIG. 16. The method 1600 for driving the pixel structure further comprises:

step 1630: controlling the third LED to emit the third color light.

In step 1630, the third LED D3 is controlled to emit the third color light. In one embodiment, the first color light, the second color light, and the third color light are the same, and the frequency spectrum peak value h of the first color light, the frequency spectrum peak value h' of the second color light, and the frequency spectrum peak value h" of the third color light are different so as to further enlarge the adjustable color gamut of the LEDs. Additionally, the NTSC range being covered is also further enlarged to improve the color gamut of the display panel.

In still another embodiment, a description is provided with reference to FIG. 9 and FIG. 10. The method 1600 for driving the pixel structure further comprises: receiving the high-level first common voltage by the second signal line C1 during the first period P1, receiving the high-level second common voltage by the third signal line Tc during the second period P2, and receiving the high-level third common voltage by the fourth signal line C2 during the third period P3. Hence, the first LED a, the second LED a', and the third LED a" can be respectively operated by utilizing the above configuration and driving method.

In yet another embodiment, a description is provided with reference to FIG. 9 and FIG. 11. The method 1600 for driving the pixel structure further comprises: providing the driving signal to the first signal line M11 by the driving circuit Cd11, the driving signal comprising various voltage levels Vt1-Vt3, or the driving signal comprising various periods T1-T3; controlling the first LED a according to the driving signal and the first common voltage (the second signal line C1 receives the first common voltage), controlling the second LED a' according to the driving signal and the second common voltage (the third signal line Tc receives the second common voltage), and controlling the third LED a" according to the driving signal and the third common voltage (the fourth signal line C2 receives the third common voltage) by the driving circuit Cd11. Hence, the driving circuit Cd11 can drive the first LED a, the second LED a', and the third LED a" either through the voltage driving manner (different voltage levels Vt1-Vt3) or the time driving manner (different periods T1-T3).

In another embodiment, a description is provided with reference to FIG. 12. The method 1600 for driving the pixel structure further comprises: the first sub-pixel SP11, the second sub-pixel SP21, and the third sub-pixel SP 31 respectively emitting one of the first color light, the second color light, and the third color light to allow the pixel structure to simultaneously emit the first color light, the second color light, and the third color light.

For example, the method 1600 for driving the pixel structure further comprises: the first LED a in the first sub-pixel SP11 emitting the first color light (such as red light), the second LED b' in the second sub-pixel SP21 emitting the second color light (such as green light), and the third LED c" in the third sub-pixel SP31 emitting the third color light (such as blue light) during the first period P1; the second LED a' in the first sub-pixel SP11 emitting the second color light (such as green light), the third LED b" in the second sub-pixel SP21 emitting the third color light (such as blue light), and the first LED c in the third sub-pixel SP31 emitting the first color light (such as red light) during the second period P2.

Additionally, the method 1600 for driving the pixel structure further comprises: the third LED a" in the first sub-pixel SP11 emitting the third color light (such as blue light), the first LED b in the second sub-pixel SP21 emitting the first color light (such as red light), and the second LED c' in the third sub-pixel SP31 emitting the second color light (such as green light) during the third period P3. As shown above, in the present embodiment, the red LED, the green LED, and the blue LED in each of the first sub-pixel SP11, the second sub-pixel SP21, and the third sub-pixel SP31 can take turns to emit light to improve heat dissipation efficiency so as to avoid heat accumulation. The luminous efficiency of LEDs is thus not affected. Additionally, emitting lights in turn would lengthen the lifetime of LEDs.

In still another embodiment, a description is provided with reference to FIG. 12. The method 1600 for driving the pixel structure further comprises: the first sub-pixel SP11, the second sub-pixel SP21, and the third sub-pixel SP31 simultaneously emitting the first color light (such as red light) during the first period P1; and the first sub-pixel SP11, the second sub-pixel SP21, and the third sub-pixel SP31 simultaneously emitting the second color light (such as green light) during the second period P2. In addition, the method 1600 for driving the pixel structure further comprises: the first sub-pixel SP11, the second sub-pixel SP21, and the third sub-pixel SP31 simultaneously emitting the third color light (such as blue light) during the third period P3.

In another embodiment, during the third period P3, the first sub-pixel SP11, the second sub-pixel SP21, and the third sub-pixel SP 31 simultaneously emit the first color light (such as red light), the second color light (such as green light), and the third color light (such as blue light). Or, the first sub-pixel SP11, the second sub-pixel SP21, and the third sub-pixel SP 31 simultaneously emit any two of the first color light (such as red light), the second color light (such as green light), and the third color light (such as blue light). As shown above, in the present embodiment, applying the field sequential color (FSC) method to the pixel structure adopting LEDs allows the resolution to be further improved.

In still another embodiment, a description is provided with reference to FIG. 13 and FIG. 16. Step 1610 comprises: controlling the first LED D1 to emit the first color light by the IC. Step 1620 comprises: controlling the second LED D2 to emit the second color light by the IC. In addition, the method 1600 for driving the pixel structure further comprises: controlling the third LED D3 to emit the third color light by the IC. In the present embodiment, the LEDs in the pixel are controlled by the IC. Since one IC is able to control multiple LEDs and an IC is small, the resolution is thus improved.

Those skilled in the art will appreciate that each of the steps of the method for driving the pixel structure named after the function thereof is merely used to describe the technology in the embodiment of the present disclosure in detail. Therefore, combining the steps of said method into one step, dividing the step into several steps, or rearranging the order of the steps is within the scope of the embodiment in the present disclosure.

It is understood from the embodiments of the present disclosure that applying the present disclosure has the following advantages. The embodiments of the present disclosure provide a pixel structure and a method for driving the same to improve the problem that the luminous efficiency of the LEDs in the display is seriously impacted because of the temperature rise of the display. The improvement method avoids heat accumulation by alternate emitting of the LEDs so that the luminous efficiency of the LEDs is not affected.

In addition, the frequency spectrum peak values of lights emitted by a plurality of LEDS can be different. Therefore, the adjustable color gamut of the LEDs is enlarged and the NTSC range being covered is also enlarged to improve the color gamut of the display panel. Additionally, applying field sequential color (FSC) method to the pixel structure adopting LEDs allows the resolution to be further improved. Besides, the LEDs in the pixel can be controlled by the IC. Since one IC is able to control multiple LEDs and an IC is small, the resolution is thus improved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A pixel structure comprising:

a plurality of sub-pixels, each of the sub-pixels comprising:

a first light-emitting diode (LED) configured to emit a first color light; and a second LED configured to emit a second color light;

wherein each of the first LED and the second LED comprises an anode and a cathode, the anode of the first LED and the anode of the second LED are coupled to a same signal line, the cathode of the first LED and the cathode of the second LED are coupled to different signal lines, wherein the first color light is the same as the second color light, and a frequency spectrum peak value of the first color light is different from a frequency spectrum peak value of the second color light.

2. The pixel structure of claim 1, wherein the first LED emits the first color light during a first period, and the second LED emits the second color light during a second period.

3. The pixel structure of claim 2, wherein the anode of the first LED and the anode of the second LED are both coupled to a first signal line, and the cathode of the first LED and the cathode of the second LED are respectively coupled to a second signal line and a third signal line.

4. The pixel structure of claim 3, wherein the second signal line is coupled to a first common electrode, and the third signal line is coupled to a second common electrode, wherein the first common electrode provides a high-level first common voltage to the second signal line during the first period, and provides a low-level first common voltage to the second signal line during the second period, wherein the second common electrode provides a high-level second common voltage to the third signal line during the second period, and provides a low-level second common voltage to the third signal line during the first period.

5. The pixel structure of claim 4, further comprising:

a driving circuit coupled to the first signal line, wherein the driving circuit is configured to control the first LED in cooperation with the first common electrode, and control the second LED in cooperation with the second common electrode.

6. The pixel structure of claim 5, wherein the driving circuit is configured to provide a driving signal to the first signal line, wherein the driving signal comprises various voltage levels, or the driving signal comprises various periods.

7. The pixel structure of claim 2, wherein when the first LED emits light, the second LED does not emit light, when the second LED emits light, the first LED does not emit light.

8. The pixel structure of claim 1, wherein the frequency spectrum peak value of the first color light corresponds to a first wavelength, and the frequency spectrum peak value of the second color light corresponds to a second wavelength, wherein a wavelength difference between the first wavelength and the second wavelength is substantially less than or equal to 50 nanometers.

9. The pixel structure of claim 1, wherein each of the sub-pixels further comprises:

a third LED configured to emit a third color light;

wherein the first color light, the second color light, and the third color light are the same, and a frequency spectrum peak value of the first color light, a frequency spectrum peak value of the second color light, and a frequency spectrum peak value of the third color light are different.

10. The pixel structure of claim 1, wherein each of the sub-pixels further comprises:

a third LED configured to emit a third color light;

wherein the third LED comprises an anode and a cathode, the anode of the first LED, the anode of the second LED, and the anode of the third LED are coupled to the same signal line, and the cathode of the first LED, the cathode of the second LED, and the cathode of the third LED are coupled to different signal lines.

11. The pixel structure of claim 10, wherein the anode of the first LED, the anode of the second LED and the anode of the third LED are all coupled to a first signal line, and the cathode of the first LED, the cathode of the second LED, and the cathode of the third LED are respectively coupled to a second signal line, a third signal line, and a fourth signal line.

12. The pixel structure of claim 11, wherein the second signal line receives a high-level first common voltage during a first period, the third signal line receives a high-level second common voltage during a second period, and the fourth signal line receives a high-level third common voltage during a third period.

13. The pixel structure of claim 12, further comprising:

a driving circuit coupled to the first signal line and configured to provide a driving signal to the first signal line, wherein the driving signal comprises various voltage levels, or the driving signal comprises various periods, wherein the driving circuit is configured to control the first LED according to the driving signal and the first common voltage, and control the second LED according to the driving signal and the second common voltage, and control the third LED according to the driving signal and the third common voltage.

14. The pixel structure of claim 10, wherein the plurality of sub-pixels comprise a first sub-pixel, a second sub-pixel, and a third sub-pixel, wherein the first sub-pixel, the second sub-pixel, and the third sub-pixel respectively emit one of the first color light, the second color light, and the third color light to allow the pixel structure to simultaneously emit the first color light, the second color light, and the third color light.

15. The pixel structure of claim 14, wherein the first LED in the first sub-pixel emits the first color light, the second LED in the second sub-pixel emits the second color light, and the third LED in the third sub-pixel emits the third color light during a first period, wherein the second LED in the first sub-pixel emits the second color light, the third LED in the second sub-pixel emits the third color light, and the first LED in the third sub-pixel emits the first color light during a second period.

16. The pixel structure of claim 15, wherein the third LED in the first sub-pixel emits the third color light, the first LED in the second sub-pixel emits the first color light, and the second LED in the third sub-pixel emits the second color light during a third period.

17. The pixel structure of claim 10, wherein the plurality of sub-pixels comprise a first sub-pixel, a second sub-pixel, and a third sub-pixel, wherein the first sub-pixel, the second sub-pixel, and the third sub-pixel simultaneously emit the first color light during a first period, and the first sub-pixel, the second sub-pixel, and the third sub-pixel simultaneously emit the second color light during a second period.

18. The pixel structure of claim 17, wherein the first sub-pixel, the second sub-pixel, and the third sub-pixel simultaneously emit the third color light during a third period.

19. The pixel structure of claim 17, wherein the first sub-pixel, the second sub-pixel, and the third sub-pixel simultaneously emit the first color light, the second color light, and the third color light during a third period, or the first sub-pixel, the second sub-pixel, and the third sub-pixel simultaneously emit any two of the first color light, the second color light, and the third color light during the third period.

20. The pixel structure of claim 1, further comprising:

an integrated circuit coupled to the first LED and the second LED and configured to control the first LED and the second LED.

21. The pixel structure of claim 20, further comprising:

a third LED configured to emit a third color light, wherein the integrated circuit is further configured to control the third LED.

22. A method for driving a pixel structure, wherein the pixel structure comprises a plurality of sub-pixels, each of the sub-pixels comprising a first light-emitting diode (LED) and a second LED, wherein each of the first LED and the second LED comprises an anode and a cathode, the anode of the first LED and the anode of the second LED are coupled to a same signal line, and the cathode of the first LED and the cathode of the second LED are coupled to different signal lines, wherein the method for driving the pixel structure comprising:

controlling the first LED to emit a first color light; and controlling the second LED to emit a second color light, wherein the first color light is the same as the second color light, and a frequency spectrum peak value of the first color light is different from a frequency spectrum peak value of the second color light.

23. The method for driving the pixel structure of claim 22, wherein controlling the first LED to emit the first color light comprises:

controlling the first LED to emit the first color light during a first period;

wherein controlling the second LED to emit the second color light comprises:

controlling the second LED to emit the second color light during a second period.

24. The method for driving the pixel structure of claim 23, wherein the anode of the first LED and the anode of the second LED are both coupled to a first signal line, and the cathode of the first LED and the cathode of the second LED are respectively coupled to a second signal line and a third signal line, wherein the second signal line is coupled to a first common electrode, and the third signal line is coupled to a second common electrode, wherein the method for driving the pixel structure further comprises:

providing a high-level first common voltage to the second signal line during the first period and providing a low-level first common voltage to the second signal line during the second period by the first common electrode; and providing a high-level second common voltage to the third signal line during the second period and providing a low-level second common voltage to the third signal line during the first period by the second common electrode.

25. The method for driving the pixel structure of claim 24, wherein the pixel structure further comprises a driving circuit, the driving circuit is coupled to the first signal line, wherein controlling the first LED to emit the first color light comprises:

controlling the first LED to emit the first color light by the driving circuit in cooperation with the first common electrode;

wherein controlling the second LED to emit the second color light comprises:

controlling the second LED to emit the second color light by the driving circuit in cooperation with the second common electrode.

26. The method for driving the pixel structure of claim 25, further comprising:

providing a driving signal to the first signal line by the driving circuit, wherein the driving signal comprises various voltage levels, or the driving signal comprises various periods.

27. The method for driving the pixel structure of claim 22, wherein the frequency spectrum peak value of the first color light corresponds to a first wavelength, the frequency spectrum peak value of the second color light corresponds to a second wavelength, wherein a wavelength difference between the first wavelength and the second wavelength is substantially less than or equal to 50 nanometers.

28. The method for driving the pixel structure of claim 22, wherein each of the sub-pixels further comprises a third LED, wherein the method for driving the pixel structure further comprises:

controlling the third LED to emit a third color light, wherein the first color light, the second color light, and the third color light are the same, and a frequency spectrum peak value of the first color light, a frequency spectrum peak value of the second color light, and a frequency spectrum peak value of the third color light are different.

29. The method for driving the pixel structure of claim 28, wherein the plurality of sub-pixels comprise a first sub-pixel, a second sub-pixel, and a third sub-pixel, wherein the method for driving the pixel structure further comprises:

emitting one of the first color light, the second color light, and the third color light by each of the first sub-pixel, the second sub-pixel, and the third sub-pixel to allow the pixel structure to simultaneously emit the first color light, the second color light, and the third color light.

30. The method for driving the pixel structure of claim 29, further comprising:

emitting the first color light by the first LED in the first sub-pixel, emitting the second color light by the second LED in the second sub-pixel, and emitting the third color by the third LED in the third sub-pixel during a first period; and emitting the second color light by the second LED in the first sub-pixel, emitting the third color light by the third LED in the second sub-pixel, and emitting the first color light by the first LED in the third sub-pixel during a second period.

31. The method for driving the pixel structure of claim 30, further comprising:

emitting the third color light by the third LED in the first sub-pixel, emitting the first color light by the first LED in the second sub-pixel, and emitting the second color by the second LED in the third sub-pixel during a third period.

32. The method for driving the pixel structure of claim 28, wherein the plurality of sub-pixels comprise a first sub-pixel, a second sub-pixel, and a third sub-pixel, wherein the method for driving the pixel structure further comprises:

simultaneously emitting the first color light by the first sub-pixel, the second sub-pixel, and the third sub-pixel during a first period; and simultaneously emitting the second color light by the first sub-pixel, the second sub-pixel, and the third sub-pixel during a second period.

33. The method for driving the pixel structure of claim 32, further comprising:

simultaneously emitting the third color light by the first sub-pixel, the second sub-pixel, and the third sub-pixel during a third period.

34. The method for driving the pixel structure of claim 32, further comprising:

simultaneously emitting the first color light, the second color light, and the third color light by the first sub-pixel, the second sub-pixel, and the third sub-pixel during a third period, or simultaneously emitting any two of the first color light, the second color light, and the third color light by the first sub-pixel, the second sub-pixel, and the third sub-pixel during the third period.

35. The method for driving the pixel structure of claim 22, wherein each of the sub-pixels further comprises a third LED, wherein the third LED comprises an anode and a cathode, wherein the anode of the first LED, the anode of the second LED, and the anode of the third LED are coupled to a first signal line, and the cathode of the first LED, the cathode of the second LED, and the cathode of the third LED are respectively coupled to a second signal line, a third signal line, and a fourth signal line, wherein the method for driving the pixel structure further comprises:

receiving a high-level first common voltage by the second signal line during a first period;

receiving a high-level second common voltage by the third signal line during a second period; and receiving a high-level third common voltage by the fourth signal line during a third period.

36. The method for driving the pixel structure of claim 35, wherein the pixel structure further comprises a driving circuit, and the driving circuit is coupled to the first signal line, wherein the method for driving the pixel structure further comprises:

providing a driving signal to the first signal line by the driving circuit, wherein the driving signal comprises various voltage levels, or the driving signal comprises various periods;

wherein the method for driving the pixel structure further comprises:

controlling the first LED according to the driving signal and the first common voltage, and controlling the second LED according to the driving signal and the second common voltage, and controlling the third LED according to the driving signal and the third common voltage by the driving circuit.

37. The method for driving the pixel structure of claim 22, wherein the pixel structure further comprises an integrated circuit, and the integrated circuit is coupled to the first LED and the second LED, wherein controlling the first LED to emit the first color light comprises:

controlling the first LED to emit the first color light by the integrated circuit;

wherein controlling the second LED to emit the second color light comprises:

controlling the second LED to emit the second color light by the integrated circuit.

* * * * *